United States Patent [19]

Rickey

[11] Patent Number: 4,646,839

[45] Date of Patent: Mar. 3, 1987

[54] METHOD AND APPARATUS FOR THROUGH-THE-FLOWLINE GRAVEL PACKING

[75] Inventor: Wynn P. Rickey, Houston, Tex.

[73] Assignee: Exxon Production Research Co., Houston, Tex.

[21] Appl. No.: 674,443

[22] Filed: Nov. 23, 1984

[51] Int. Cl.[4] ..... E21B 43/04; E21B 23/08

[52] U.S. Cl. ..... 166/335; 166/51; 166/155; 166/156; 166/278; 166/313; 166/383

[58] Field of Search ..... 166/278, 276, 313, 383, 166/51, 155, 156, 317, 312, 335, 362; 137/68.1

[56] References Cited

U.S. PATENT DOCUMENTS

| | | | |
|---|---|---|---|
| 2,717,041 | 9/1955 | Brown | 166/313 |
| 3,263,753 | 8/1966 | Corley, Jr. | 166/383 |
| 3,279,543 | 10/1966 | Yetman | 166/155 |
| 3,302,721 | 2/1967 | Yetman | 166/155 |
| 3,464,496 | 9/1969 | Genois et al. | 166/383 |
| 3,508,614 | 4/1970 | Bohlmann, Jr. et al. | 166/383 |
| 3,554,281 | 1/1971 | Ecuer | 166/155 |
| 3,901,318 | 8/1975 | Fortenberry | 166/278 |
| 3,902,515 | 9/1975 | Douglas et al. | 137/68.1 |
| 3,913,676 | 10/1975 | Barbee, Jr. et al. | 166/278 |
| 3,952,804 | 4/1976 | Smyrl | 166/278 |
| 4,044,832 | 8/1977 | Richard et al. | 166/278 |
| 4,299,281 | 11/1981 | Long et al. | 166/135 |
| 4,360,063 | 11/1982 | Kilgore | 166/317 |
| 4,362,181 | 12/1982 | Massey et al. | 137/68.1 |

FOREIGN PATENT DOCUMENTS

| | | | |
|---|---|---|---|
| 1490996 | 11/1977 | United Kingdom | 137/68.1 |

OTHER PUBLICATIONS

SPE paper No. 2246, "Advancements in Remote Completion and Operation of Underwater Satellite Wells", 1968, by T. W. Childers and J. O. Langley.

*Primary Examiner*—James A. Leppink
*Assistant Examiner*—Hoang C. Dang
*Attorney, Agent, or Firm*—M. L. Delflache; K. C. Johnson; M. A. Smith

[57] ABSTRACT

Methods of gravel packing a subterranean well located subsea utilizing through-the-flowline techniques are disclosed in which a sand slurry is pumped downwardly through one pipe of a dual pipe string and outwardly through an H-type crossover member (14, 15) into a perforated casing area (20) until the area is fully packed. In one method, the H-type crossover member (14) is provided with a flangible plug (**14*h*) to allow bypass of the sand slurry once the perforated casing area is filled with aggregate. In another method, the gravel packing of the perforated casing area is accomplished utilizing a special TFL tool (25) which provides for injection of the sand slurry through an H-type crossover member (15) into the perforated casing area (20**).

13 Claims, 4 Drawing Figures

METHOD AND APPARATUS FOR THROUGH-THE-FLOWLINE GRAVEL PACKING

TECHNICAL FIELD OF THE INVENTION

This invention relates to completion operations for oil and gas wells and in particular to through-the-flowline gravel packing of subsea oil and gas wells.

BACKGROUND OF THE INVENTION

In completing oil and gas wells in unconsolidated or loosely consolidated formations, it has been found necessary to "gravel pack" such formations by pumping downwardly into the well a mixture of fluid and aggregate sometimes referred to as a "sand slurry". Typically, the slurry of gravel or aggregate in a liquid carrier is pumped into the annular space between the formation and a liner in an area aligned with the production zone of the well. The gravel packing may also be pumped into the cylindrical area within a perforated casing in which a well screen is positioned in order to maintain the integrity of oil and gas flow through the production formation and into the casing.

Typically in offshore operations, it has been necessary to perform such gravel packing from a platform having well treatment tubing extending from the platform downwardly through the wellhead and into the well. In the case of a subsea well positioned some distance away from a platform, such treatment normally requires a floating service vessel to be positioned above the well for vertical re-entry.

The avoidance of vertical re-entry has been accomplished in many subsea oil well servicing and completion operations by the utilization of through-the-flowline (TFL) tools. Typically, TFL tools require a particular configuration of platform equipment including a hydraulic tool stuffer (horizontal lubricator) designed to admit the TFL tool into a line that may be under pressure. The tool is then pumped downwardly through tubing to a subsea christmas tree designed to guide the tool smoothly from the flowline or tubing into the wells' tubing string. The well tubing may be a dual string tubing completion having one or more H-member type crossovers to allow the TFL tool to be circulated downwardly through one of the tubings of the dual string, through the H-member crossover and then recovered by reversing the direction of flow through the other tubing of the dual string.

The utilization of such TFL pump down techniques allow satellite wells to be serviced from a platform not positioned over those wells by the use of interconnecting tubing or flowlines for delivering and returning the TFL tool from the satellite well to the platform. Typical through-the-flowline operations utilizing TFL tools include paraffin scraping; downhole equipment service such as storm choke service; gas lift installation; bottom hole pressure measurements; and, workover operations including eliminating sand bridges and sand washing. Insofar as known, through-the-flowline operations have not been used to gravel pack a well.

SUMMARY OF THE INVENTION

It is an object of this invention to gravel pack a subterranean oil or gas well located subsea utilizing through-the-flowline techniques thereby avoiding the necessity of direct vertical re-entry from a floating service vessel or the like. In accordance with this invention, such a method of gravel packing includes utilization of a dual string having an H-type crossover member set at the production formation at the end of a dual pipe string which has been installed in casing in a well bore. After the casing is perforated, a sand slurry consisting of liquid and aggregate is pumped downwardly through one of the pipe strings and outwardly into the area of the perforated casing in order to pack the perforated casing by depositing the aggregate and returning the liquid upwardly through the other of the pipe strings. The gravel packing is continued until the area within the perforated casing is sufficiently filled with aggregate that return of liquid is inhibited. Thereafter, flow of sand slurry outwardly of one of the pipe strings is discontinued and the pipe string is plugged off. This description of the invention is intended as a summary only. The specific details of the methods of gravel packing of this invention will be described in the specification to follow and the claims which follow the specification will specifically point out the invention.

DESCRIPTION OF THE PREFERRED EMBODIMENT

Figure 2:
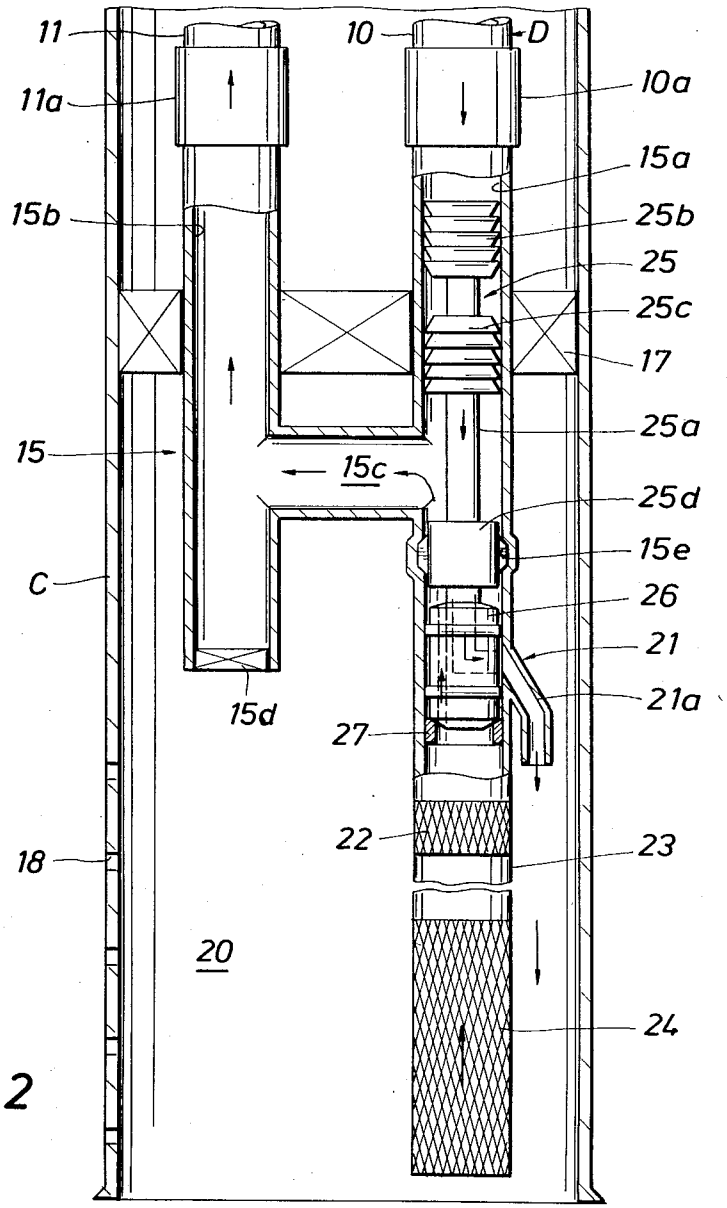
FIG. 2 is a schematic view of an H-type crossover member mounted at the end of a dual pipe string illustrating a second method of gravel packing in accordance with this invention utilizing a through-the-flowline tool.
Figure 1:
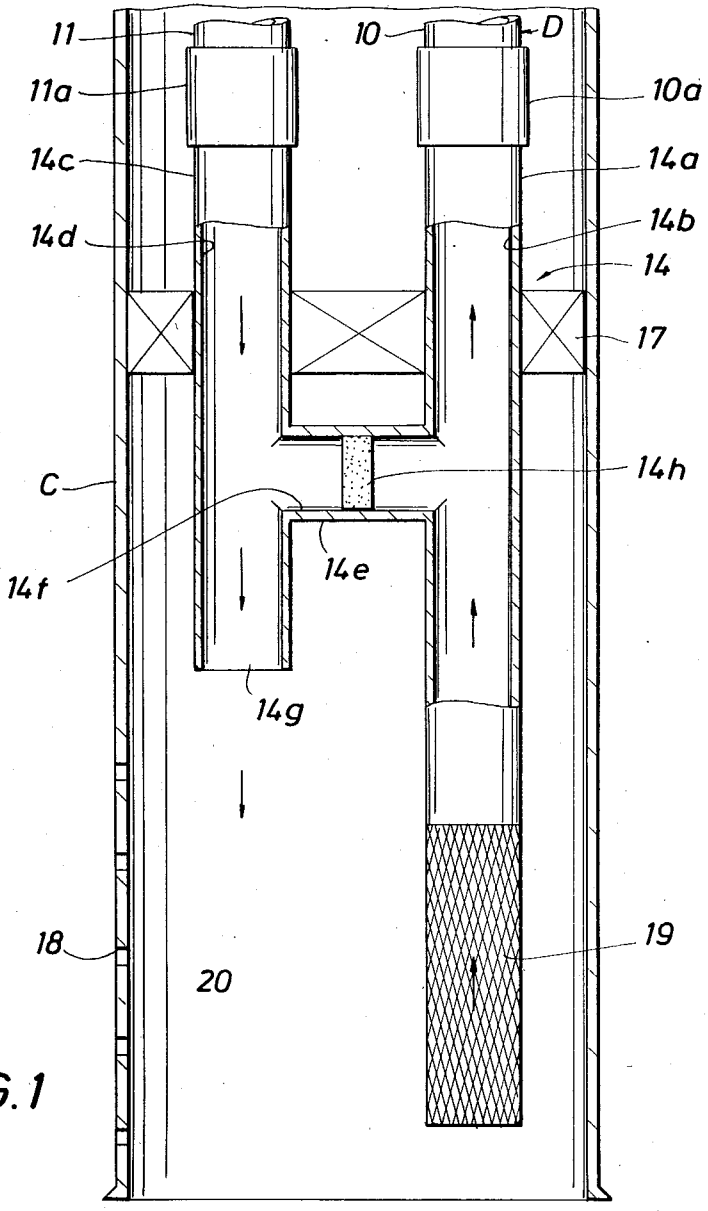
FIG. 1 is a schematic view of an H-type crossover member mounted at the end of a dual pipe string for illustrating one method of gravel packing of this invention.

Referring to the drawings, FIG. 1 and FIGS. 2–4 illustrate alternate methods for gravel packing a subterranean well located subsea. Referring to FIGS. 1 and 2, the letter C designates a casing which extends downwardly from a "christmas tree" ( a subsea wellhead structure, not shown) to a production formation from which oil and/or gas is to be produced. Referring to FIGS. 1 and 2, a dual pipe string generally designated as D is set into the casing C. The dual pipe string D includes a first pipe string 10 and a second pipe string 11, both of which extend from the christmas tree downwardly through the casing C into the area of the production zone for the oil or gas well. The dual pipe strings 11 and 12 terminate in an H-type crossover tool generally designated as 14 in FIGS. 1 and 15 in FIG. 2. The H-type crossover tools 14 and 15 are schematically illustrated in FIGS. 1 and 2, respectively. The H-type crossover members 14 and 15 are generally of a structure known in the art. For example, H-type crossover members are manufactured by Otis Engineering Corporation of Dallas, Texas and are known as Otis Pump Down H Members.

The H-type crossover member 14 includes a first tubular section **14*a* having longitudinal bore 14*b* and a second tubular section 14*c* having a longitudinal bore 14*d*. The tubular sections 14*a* and 14*c* are interconnected by a transverse tubular section 14*e*** having bore 14*f*. The H-type crossover member 14 is connected to the first and second pipe strings 10 and 11 by suitable sleeve connectors illustrated schematically at 10*a* and 11*a*, respectively. A dual-type packer identified as 17 and schematically illustrated in FIG. 1 is attached to the H-type crossover member 14 and extends into engagement with the interior surface of the casing and is provided to seal off the region within the casing below the packer 17 for the purpose of directing oil and gas production through the H-type crossover member. A suitable dual packer 17 is the RDH Hydraulic-Set Dual Packer manufactured by Otis Engineering Corporation of Dallas, Tex. The H-type crossover member 15 for the method of gravel packing illustrated in FIGS. 2–4 will be discussed hereinafter.

Figure 3:
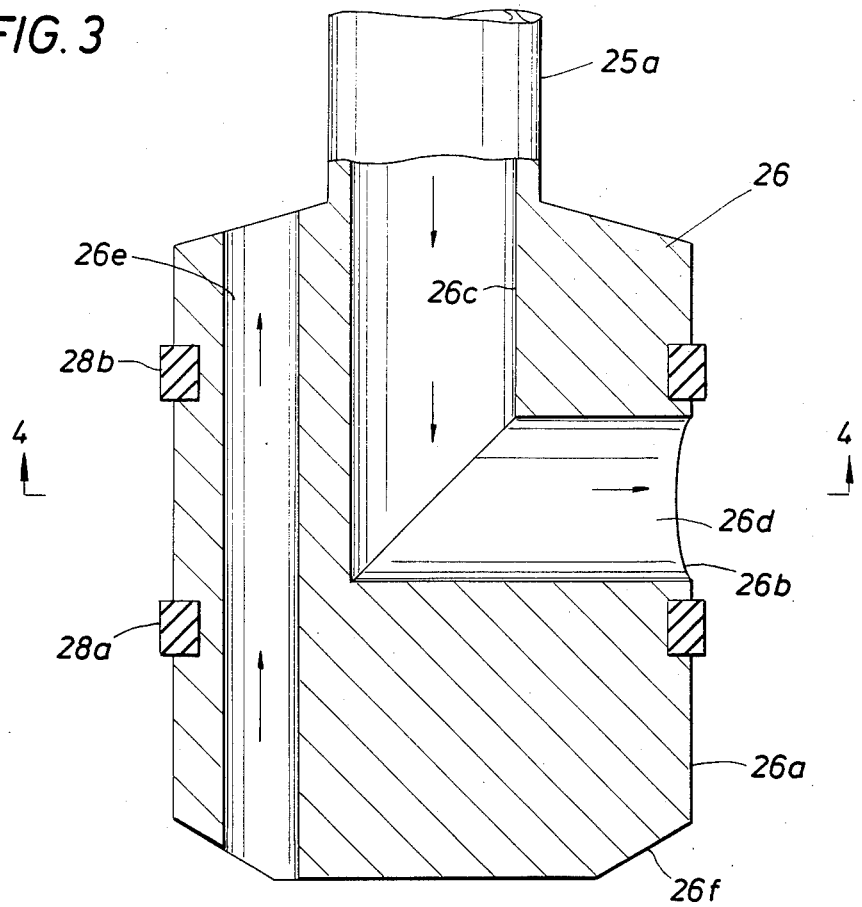
FIG. 3 is a sectional view taken along line 3—3 of FIG. 4 of the injection head of the through-the-flowline tool utilized in accomplishing the gravel packing of the method of FIG. 3.
Figure 4:
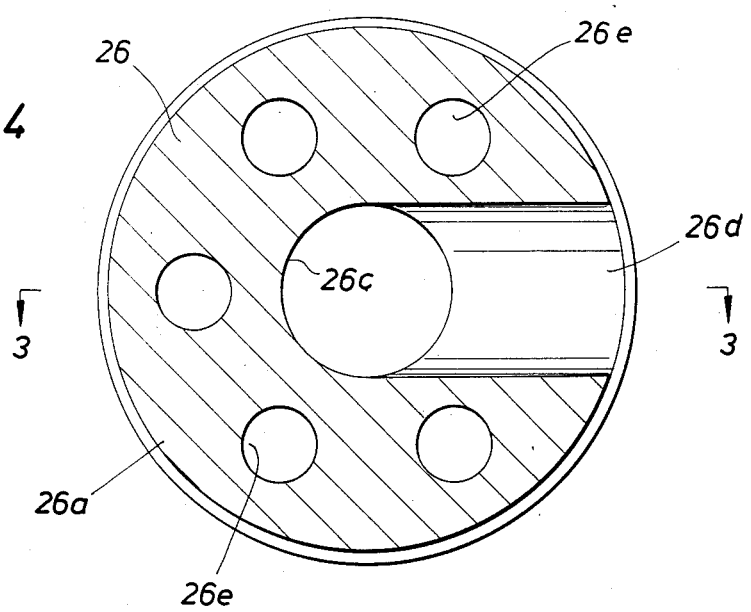
FIG. 4 is a sectional view taken along line 4—4 of FIG. 3 of the injection head of the through-the-flowline tool.

FIG. 1 illustrates schematically one method of gravel packing using through-the-flowline techniques while FIGS. 2–4 illustrate an alternate method using a through-the-flowline (TFL) tool. For both methods, it is first necessary, after setting the dual pipe string D and the H-type crossover member 14 in position within the casing C in the area of the oil and gas producing zone, to perforate the casing C. One method of perforating the casing at a subsea location is described in a publication SPE446 of the Society of Petroleum Engineers of AIME. entitled "Advancement in Remote Completion and Operation of Underwater Satellite Wells" by T. W. Childers and J. 0. Langley published in 1968. As disclosed in this publication, pump down tools are utilized to circulate a perforating gun assembly through-the-flowline tool through a dual string D and H-type crossover member 14 and to fire the perforating gun just below the longitudinal tubular section 14*c* of the H-type crossover member to create a series of perforations 18 on the side of the casing C located below longitudinal bore outlet 14*g* from bore 14*d*. After the perforator gun is fired and the perforations 18 are accomplished, the through-the-flowline (TFL) perforator tool is removed by reverse circulation as disclosed.

Referring now in particular to the method of gravel packing illustrated in FIG. 1, the H-type crossover member 14 is provided with frangible plug 14*h* mounted in the transverse bore 14*f*. The plug is made of a frangible material of certain thickness such that the plug will break in response to a predetermined minimum pressure differential between longitudinal bore 14*d* and longitudinal bore 14*b* of the H-type crossover member 14. The particular material for the frangible plug as well as the thickness are selectable by persons of ordinary skill in this art. A well screen 19 is attached to the end of the tubular structure 14*a* of the H-type crossover member forming the longitudinal bore 14*b*. The well screen 19, sometimes referred to as a "liner" or "perforated liner" may be any of a wide range of tubular subsurface devices used in wells including "perforated liners", "vertically slotted liners", "horizontally slotted liners", "screens", "prepacked screens", "wire wrapped screens" available from various manufacturers and which are provided with openings or slots of sufficient width to allow only the passage of oil, gas or liquid and prevent the passage of the aggregate used in the gravel packing. A method of gravel packing utilizing through-the-flowline techniques may be utilized to gravel pack the area 20 within the perforated casing 20 as follows. A "sand slurry" consisting of a properly sized aggregate and carrier fluid such as gelled fluid known in the art is pumped down through the flowlines connected from the platform or a central servicing christmas tree, through the christmas tree and into the dual pipe string D of the well to be gravel packed. The slurry is pumped downwardly through pipe string 11, longitudinal bore 14*d* and outwardly of outlet 14*g* at the bottom of the longitudinal bore 14*b*. The carrier or gelled fluid is typically a fluid of high viscosity which keeps the aggregate in suspension as it is pumped. It is understood that the "sand slurry" is actually a combination of the aggregate and carrier or gelled fluid with the aggregate consisting of any material which may be used for stabilizing and filtering purposes in a subsurface well. Examples of such aggregates include Ottawa sand, walnut shells or glass beads; and, the aggregate size is chosen in accordance with the sand conditions of the producing zone located outside of the series of openings 18 in the casing C. The sand slurry is pumped outwardly through the outlet 14*g* of the longitudinal bore 14*d* of the H-type crossover member 14 until the perforated casing area 20 surrounding the screen 19 is filled with aggregate. The screen 19 allows the carrier fluid to be returned through the screen and upwardly through the longitudinal bore 14*b* and string 10 and into return flowlines leading to the platform or to a central servicing well which has flowlines extending to the platform. As the sand slurry is circulated downwardly through outlet 14*g* and into the perforated casing area 20, and the carrier fluid is returned upwardly through longitudinal bore 14*a* of the H-type crossover member 14, the perforated casing area is filled with aggregate until the aggregate level reaches the outlet 14*g* located at the bottom of longitudinal bore 14*d*. Once the aggregate reaches and begins to close off the outlet 14*g*, a pressure increase occurs within the longitudinal bore 14*d* and the bore of the pipe string 11 until the pressure exceeds the burst level of the frangible plug 14*h* positioned in the transverse bore 14*f*. The frangible plug 14*h* breaks or bursts at the predesignated increased pressure level and thereafter the sand slurry is deviated through the transverse bore 14*f* and directy upwardly into the return circulation bore 14*b*. Typically, the volume of sand slurry necessary to gravel pack the area within perforated casing 20 is calculated to avoid unnecessary recirculation of sand slurry after the outlet 14*g* is adequately covered and the perforated casing area 20 is filled with aggregate. Thereafter a plug is set in a known manner in the outlet 14*g* and the dual circulation bores of the pipe string members 10 and 11 are cleaned and flow tested for production.

Referring to FIGS. 2–4, an alternative method of gravel packing a subterranean well utilizing through-the-flowline techniques is illustrated. More particularly, the method of gravel packing illustrated in FIGS. 2–4 utilizes a special through-the-flowline (TFL) tool in combination with a dual string D and an H-type crossover member 15. The design of the H-type crossover member 15 is varied or modified from the design of the H-type crossover member 14 of FIG. 1. Referring to FIG. 2, the H-type crossover member 15 is formed of tubular sections interconnected in an H configuration to form a first longitudinal bore 15*a*, a second longitudinal bore 15*b* and a transverse bore 15*c*. A plug 15*d* is mounted at the lower end of the longitudinal bore 15*b*. A locking recess 15*e* is provided in the longitudinal bore 15*a* just below the intersection of the longitudinal bore 15*a* with the transverse bore 15*c*. Additionally, a side pocket mandrel 21 is mounted within the longitudinal bore 15*a* below the locking recesses 15*e*. The side pocket mandrel 21 includes an outlet 21*a* through which sand slurry can be injected into the perforated casing area 20. A tell-tale well screen 22 is mounted onto the H-type crossover member 14 below the side pocket mandrel 21. A pipe section 23 is attached below the tell-tale screen 22 and a full well screen 24 is attached to the pipe section 23. Packer 17 isolates the bottom portion of H-type member 15. After a series of perforations 18 are provided in the casing C offside from the well screen 24, a through-the-flowline (TFL) tool 25 is circulated downwardly through the pipe string 10 of the dual string D and into longitudinal bore 15*a* of the H-type crossover member 15. The TFL tool 25 can be circulated, for example, from a central platform located at the ocean surface downwardly through flowlines leading to a satellite well which needs to be gravel packed.

The TFL flowline tool 25 includes a central conduit 25*a* having a first and second set of pistons or locomotives 25*b* and 25*c* attached to the conduit's upper end as illustrated in FIG. 2. Such pistons 25*b* and 25*c* are of a type typically used on TFL tools. It is known to utilize such piston units 25*b* in order to propel the TFL tool 25 downwardly into the pipe string 10 and into the H-type crossover member 15 and to thereafter apply reverse circulation through the dual string D in order to remove the TFL tool 25. In order to allow reverse circulation to remove the tool, the lower piston, section 25*c* faces oppositely from the piston unit 25*b*.

The TFL tool 25 also includes a locking mandrel 25*d*, a known component of TFL tools, which includes locking elements which can be extended into engagement with the sides of the locking recess 15*e* in order to hold the TFL tool in position. Known types of piston units or locomotives and locking mandrels are manufactured by Otis Engineering Corporation of Dallas, Tex. The special TFL gravel packing tool 25 further includes a generally cylindrical injector head 26 which is mounted onto the lower end of the conduit 25*a*. Referring in particular to FIGS. 3–4, the injector head 26 includes a generally cylindrical body 26*a* having an overall outside diameter slightly less than the diameter of the internal bore of the pipe string 10 and the bore 15*a* of the H-type crossover member 15. The generally cylindrical body 26*a* includes an injector bore 26*b* which consists of a longitudinal bore portion 26*c* which extends along the longitudinal axis of the cylindrical body 26*a* and a transverse or radial bore portion 26*d* which extends transversely or radially with respect to the cylindrical body 26*a*. The longitudinal bore 26*c* is in fluid communication with the conduit 25*a* (the actual connection between the conduit 25*a* and the generally cylindrical body 26*a* being illustrated schematically in FIG. 3).

The generally cylindrical body 26*a* further includes a plurality of circumferentially spaced carrier fluid return bores 26*e* which are machined at circumferentially spaced intervals in the generally cylindrical body 26*a*. The body 26*a* further includes an annular, beveled or inclined bottom shoulder portion 26*f* which is inclined at a proper angle to land against a landing nipple 27 positioned above the tell-tale screen 22 and below the side pocket mandrel 21 in the H-type crossover member. Spaced seal rings 28*a* and 28*b* are mounted in annular grooves in the exterior cylindrical surface of the injector head body 26*a*. The seal rings 28*a* and 28*b* extend transversely across the longitudinal axis of the body 26*a* and are positioned above and below the transverse bore portion 26*d*.

In practice of the method of gravel packing illustrated in FIGS. 2–4, the TFL tool 25 is circulated downwardly through the pipe string 10 and into the longitudinal bore 15*a* of the H-type crossover member 15. The cylindrical injector head 26 is landed upon the landing nipple 27 thereby positioning the transverse bore portion 26*d* in alignment with the outlet 21*a* of the side pocket mandrel 21. The locking mandrel 25*d* is activated in a known manner to extend locking elements into the locking recess 15*e* to thereby secure the position of the tool within the longitudinal bore 15*a* of the H-type crossover member 15.

A sand slurry consisting of aggregate in a carrier or gelled fluid is pumped downwardly through the pipe string 10 and the conduit 25*a* and outwardly of injector head bore portions 26*c* and 26*d* and through the outlet 21*a* of the mandrel 21 into the perforated casing area 20. The carrier or gelled fluid is returned through the screen 24 and upwardly through the return passages or bores 26*e*. The return fluid then flows through the transverse bore 15*c* and the longitudinal bore 15*b* of the H-type crossover member 15 and into the bore of pipe string 11 for return to the platform. The perforated casing area 20 is thus packed with aggregate until the aggregate builds up over tell-tale screen 22 which causes a pressure build up within the flow of sand slurry entering into the TFL tool. The pressure build up is sensed on the operating platform so that the operator will know that the gravel packing is substantially completed. Thereafter, the TFL tool 25 is removed by reverse circulation of fluid downwardly through the bore of pipe string 11, and longitudinal bore 15*b* and through transverse bore 15*c* such that the fluid acts against the oppositely directed piston 25*c* to reverse the TFL tool out of the H-type crossover member and bore of pipe string 10 and return the tool to the platform. The mandrel 21 is then plugged in a known manner and known cleaning steps are taken to clear the dual string D so that production may begin.

The foregoing disclosure and description of the invention are illustrative and explanatory thereof, and various changes in the size, shape and materials, as well as in the details of the illustrated construction may be made without departing from the spirit of the invention. For example, it should be understood that the gravel packing steps described in this invention may also be utilized to gravel pack off formations located at intermediate levels within a bore hole.

I claim:

1. A method of gravel packing a subterranian well located subsea utilizing through-the-flowline techniques wherein an H-type crossover member is attached to a dual pipe string run in casing in a well bore, and the casing is perforated, comprising the steps of:

pumping a sand slurry consisting of liquid and aggregate downwardly through one of the pipe strings and outwardly into the area of the perforated casing in order to pack said perforated casing area by depositing said aggregate and returning said liquid upwardly through the other of said pipe strings;

continuing to pack said perforated casing area until sufficiently filled with aggregate that return flow of liquid is inhibited;

conducting the return flow of liquid from said one pipe string to said other pipe string through said H-type crossover member; and discontinuing flow of sand slurry outwardly of said one pipe string and plugging off said one pipe string.

2. The method set forth in claim 1, including:

placing a return flow screen on said other pipe string to substantially prevent the return of aggregate and allow said liquid to return through said other pipe string.

3. The method set forth in claim 1, comprising:

running a through-the-flowline tool into said one pipe string and providing said through-the-flowline tool with a sand slurry injection conduit and directing said sand slurry outwardly of said one pipe string through said injection conduit into said perforated casing area.

4. The method set forth in claim 3, including:

said H-type crossover member having an outlet in fluid communication with said one pipe string; and providing said through-the-flowline tool with an injector head attached to and in fluid communication with said sand slurry injection conduit and positioning said injector head to seal off said outlet in said H-type crossover member in fluid communication with said one pipe string and directing said slurry through said one pipe string, said conduit and injector head of said through-the-flowline tool outwardly into said perforated casing area.

5. The method set forth in claim 4, including:

setting a side pocket mandrel in said H-type crossover member to provide said outlet and positioning said injector head in alignment with said side pocket mandrel to deliver said sand slurry outwardly of said side pocket mandrel.

6. A through-the-flowing tool for travel through the flowlines and pipe string of a subsea oil/gas well, comprising:

a generally elongated conduit member having first and second ends and a bore therethrough;

a piston attached to said first end of said conduit member for sealably engaging the internal wall surface of said subsea flowlines and pipe string whereby fluid pumped through said flowlines and pipe string can be used to propel said through-the-flowline tool through said flow lines and pipe string; and a fluid injector head attached to said second end of said conduit, said fluid injector head having a plurality of fluid return bores extending longitudinally of said injector head and having an injector bore in fluid communication with said bore of said conduit member for directing sand slurry supplied through said bore of said conduit member outwardly of said injection head.

7. The structure set forth in claim 6, including:

said injector head bore having a first bore portion aligned with said bore of said conduit and a second bore portion directed transverse to said first bore portion to direct fluid outwardly thereof.

8. The structure set forth in claim 6, including:

first and second circumferential sealing elements mounted with said injector head, said sealing elements being positioned on opposite sides of said injector head at said injector bore.

9. A method of gravel packing a subterranian well located subsea utilizing through-the-flowline techniques wherein an H-type crossover member having separate and parallel longitudinal bores and a lateral bore is attached to a dual pipe string having first and second pipe strings run in casing in a well bore, and the casing is perforated, comprising the steps of:

mounting a frangible plug in said lateral bore to isolate the first pipe string from directly receiving any of a sand slurry consisting of liquid and aggregate flowing downwardly through the second pipe string until a predetermined pressure level of said sand slurry breaks said frangible plug to allow direct return of said sand slurry;

pumping said sand slurry downwardly through the second pipe string and outwardly into the area of the perforated casing in order to pack said perforated casing area by depositing said aggregate and returning said liquid upwardly through the first pipe string;

continuing to pack said perforated casing area until sufficiently filled with aggregate that return flow of liquid is inhibited; and discontinuing flow of sand slurry outwardly of said second pipe string and plugging off said second string.

10. The method set forth in claim 9, including placing a return flow screen on said first pipe string to substantially prevent the return of aggregate and allow said liquid to return through said first pipe string.

11. A method of gravel packing a subterranian well located subsea utilizing through-the-flowline techniques wherein an H-type crossover member is attached to a dual pipe string run in casing in a well bore, and the casing is perforated, comprising the steps of:

pumping a sand slurry consisting of liquid and aggregate downwardly through one of the pipe strings and outwardly into the area of the perforated casing in order to pack said perforated casing area by depositing said aggregate and returning said liquid upwardly through the other of said pipe strings, said one pipe string being in fluid communication with an outlet of said H-type crossover;

continuing to pack said perforated casing area until sufficiently filled with aggregate that return flow of liquid is inhibited;

discontinuing flow of sand slurry outwardly of said one pipe string and plugging off said one string;

running a through-the-flowline tool into said one pipe string and providing said through-the-flowline tool with a sand slurry injection conduit and directing said sand slurry outwardly of said one pipe string through said injection conduit into said perforated casing area;

providing said through-the-flowline tool with an injector head attached to and in fluid communication with said sand slurry injection conduit and positioning said injector head to seal off said outlet in said H-type crossover member in fluid communication with said one pipe string and directing said slurry through said one pipe string, said conduit and injector head of said through-the-flowline tool outwardly into said perforated casing area;

setting a side pocket mandrel in said H-type crossover member to provide said outlet and positioning said ejector head in alignment with said side pocket mandrel to deliver said sand slurry outwardly of said side pocket mandrel; and returning said liquid from said perforated casing area through said injector head and through said other pipe string.

12. A through-the-flowline tool for travel through the flowlines and pipe string of a subsea oil/gas well, comprising:

a generally elongated conduit member having first and second ends and a bore therethrough;

a piston attached to said first end of said conduit for sealably engaging the internal wall surface of said subsea flowlines and pipe string whereby fluid pumped through said flowlines and pipe string can be used to propel said through-the-flowline tool;

a fluid injector head attached to said second end of said conduit, said fluid injector head having an injector bore in fluid communication with said bore of said conduit;

said fluid injector head having a generally cylindrical body;

said generally cylindrical body having an injection bore therein, said injection bore including a first portion extending longitudinally with respect to said cylindrical body and a second bore portion extending radially with respect to said cylindrical body, said first and second bore portions being in fluid communication with said conduit bore;

said generally cylindrical body having a cylindrical exterior surface and first and second sealing rings mounted onto said cylindrical surface with said transverse fluid bore position therebetween; and said generally cylindrical body further including a plurality of return flow bores positioned in a generally circumferential alignment and extending longitudinally through said generally cylindrical body.

13. A through-the-flowline tool for travel through a pipe string run in a casing in a wellbore in which the casing is perforated at a gravel pack area and terminates at a return flow screen and in which the pipe string has a side pocket mandrel outlet, said through-the-flowline tool comprising:

a generally elongated conduit member having first and second ends and a bore therethrough;

a piston attached to said first end of said conduit member for sealably engaging the internal wall surface of said pipe string whereby fluid pumped through said pipe string can be used to propel said through-the-flowline tool; and a fluid injector head attached to said second end of said conduit, said fluid injector head having an injector bore in fluid communication with said bore of said conduit member on one end and in fluid communication with said side pocket mandrel outlet on the other end for directing sand slurry supplied through said bore of said conduit member outwardly of said injector head and said side pocket mandrel outlet and into the gravel pack area within the casing, said injector head further having a plurality longitudinally extending fluid return bores.

* * * * *